US008800465B1

(12) United States Patent
Quail

(10) Patent No.: US 8,800,465 B1
(45) Date of Patent: Aug. 12, 2014

(54) RETRACTABLE ANCHORING POLE SYSTEM

(76) Inventor: Richard W. Quail, Pinellas Park, FL (US)

( * ) Notice: Subject to any disclaimer, the term of this patent is extended or adjusted under 35 U.S.C. 154(b) by 408 days.

(21) Appl. No.: 13/370,375

(22) Filed: Feb. 10, 2012

Related U.S. Application Data

(63) Continuation-in-part of application No. 12/932,377, filed on Feb. 24, 2011, now Pat. No. 8,550,023.

(60) Provisional application No. 61/307,926, filed on Feb. 25, 2010.

(51) Int. Cl.
*B63B 21/24* (2006.01)
*B63B 21/26* (2006.01)
*B63B 21/50* (2006.01)

(52) U.S. Cl.
USPC ..... 114/294; 114/230.1; 114/230.13; 114/295

(58) Field of Classification Search
CPC ..... B63B 21/24; B63B 21/26; B63B 21/50; B63B 2021/003; E02B 3/24
USPC ..... 114/230.1, 230.13–230.17, 293–295; 52/155; 37/345, 346
See application file for complete search history.

(56) References Cited

U.S. PATENT DOCUMENTS 3,656,449 A * 4/1972 Mead ..... 440/36
6,041,730 A * 3/2000 Oliverio et al. ..... 114/294
7,971,548 B2 * 7/2011 Kuenzel ..... 114/294
8,550,023 B1 * 10/2013 Quail ..... 114/294

* cited by examiner

*Primary Examiner* — Ajay Vasudeva

(57) ABSTRACT

A proximal pivot assembly has a proximal pivot arm with proximal and distal ends; a first pin pivotally coupling the proximal end of the proximal pivot arm to a boat mount, a second pin attaching a stop block to the boat mount, a third pin, and a fourth pin coupling the proximal collar to the distal end of the proximal pivot arm. A distal pivot assembly has an anchoring pole mounting plate receiving an anchor pole. The anchor pole has an interior end with a fifth pin. A sixth pin pivotally couples the exterior end of a distal extension arm to the mounting plate. A distal collar with a seventh pin pivotally couples the distal collar to the distal extension arm. An extension assembly operatively couples the proximal and distal pivot assemblies.

6 Claims, 9 Drawing Sheets

64
34
60
20
18
28
14

RETRACTABLE ANCHORING POLE SYSTEM

RELATED APPLICATION

The present application is a continuation-in-part of application Ser. No. 12/932,377 filed Feb. 24, 2011 now U.S. Pat. No. 8,550,023, which is based upon Provisional Application No. 61/307,926 filed Feb. 25, 2010, the subject matter of which applications is incorporated herein by reference and the priority of which applications is claimed.

BACKGROUND OF THE INVENTION

1. Field of the Invention

The present invention relates to a retractable anchoring pole system and more particularly pertains to raising and maintaining a boat anchoring pole in an inoperative raised orientation and for lowering and maintaining the anchoring pole in an operative lowered orientation and for raising and lowering the anchoring pole between the orientations.

2. Description of the Prior Art

The use of anchoring pole systems of known designs and configurations is known in the prior art. More specifically, anchoring pole systems of known designs and configurations previously devised and utilized for the purpose of raising and lowering a boat anchoring pole are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a retractable anchoring pole system that allows raising and maintaining a boat anchoring pole in an in-operative raised orientation and for lowering and maintaining the anchoring pole in an operative lowered orientation and for raising and lowering the anchoring pole between the orientations.

In this respect, the retractable anchoring pole system according to the present invention substantially departs from the conventional concepts and designs of the prior art, and in doing so provides an apparatus primarily developed for the purpose of raising and maintaining a boat anchoring pole in an in-operative raised orientation and for lowering and maintaining the anchoring pole in an operative lowered orientation and for raising and lowering the anchoring pole between the operative and in-operative orientations.

Therefore, it can be appreciated that there exists a continuing need for a new and improved retractable anchoring pole system which can be used for raising and maintaining a boat anchoring pole in an in-operative raised orientation and for lowering and maintaining the anchoring pole in an operative lowered orientation and for raising and lowering the anchoring pole between the operative and in-operative orientations. In this regard, the present invention substantially fulfills this need.

SUMMARY OF THE INVENTION

In view of the foregoing disadvantages inherent in the known types of anchoring pole systems of known designs and configurations now present in the prior art, the present invention provides an improved retractable anchoring pole system. As such, the general purpose of the present invention, which will be described subsequently in greater detail, is to provide a new and improved retractable anchoring pole system and method which has all the advantages of the prior art and none of the disadvantages.

To attain this, the present invention essentially comprises a retractable anchoring pole system. A proximal pivot assembly is provided having a proximal pivot arm with proximal and distal ends. First, second, third, fourth pins and a proximal collar are provided. The first pin pivotally couples the proximal end of the proximal pivot arm to a boat mount. The second pin attaches a stop block to the boat mount. The fourth pin couples the proximal collar to the distal end of the proximal pivot arm.

A distal pivot assembly is provided. The distal pivot assembly has an anchor pole. An anchoring pole mounting plate receives the anchoring pole. The anchor pole has interior end with a fifth pin. A distal extension arm has an exterior end. A sixth pin pivotally couples the exterior end of the distal extension arm to the mounting plate. A distal collar with a seventh pin pivotally couples the distal collar to the distal extension arm.

Lastly, an extension assembly is provided. The extension assembly operatively couples the proximal and distal pivot assemblies.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved retractable anchoring pole system which has all of the advantages of the prior art anchoring pole systems of known designs and configurations and none of the disadvantages.

It is another object of the present invention to provide a new and improved retractable anchoring pole system which may be easily and efficiently manufactured and marketed.

It is further object of the present invention to provide a new and improved retractable anchoring pole system which is of durable and reliable constructions.

An even further object of the present invention is to provide a new and improved retractable anchoring pole system which is susceptible of a low cost of manufacture with regard to both materials and labor, and which accordingly is then susceptible of low prices of sale to the consuming public, thereby making such retractable anchoring pole system economically available to the buying public.

Even still another object of the present invention is to provide a retractable anchoring pole system for raising and maintaining a boat anchoring pole in an in-operative raised orientation and for lowering and maintaining the anchoring pole in an operative lowered orientation and for raising and lowering the anchoring pole between the orientations.

Lastly, it is an object of the present invention to provide a new and improved retractable anchoring pole system for raising and maintaining a boat anchoring pole in an inoperative raised orientation and for lowering and maintaining the anchoring pole in an operative lowered orientation and for raising and lowering the anchoring pole between the orientations, the raising and lowering and maintaining being done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
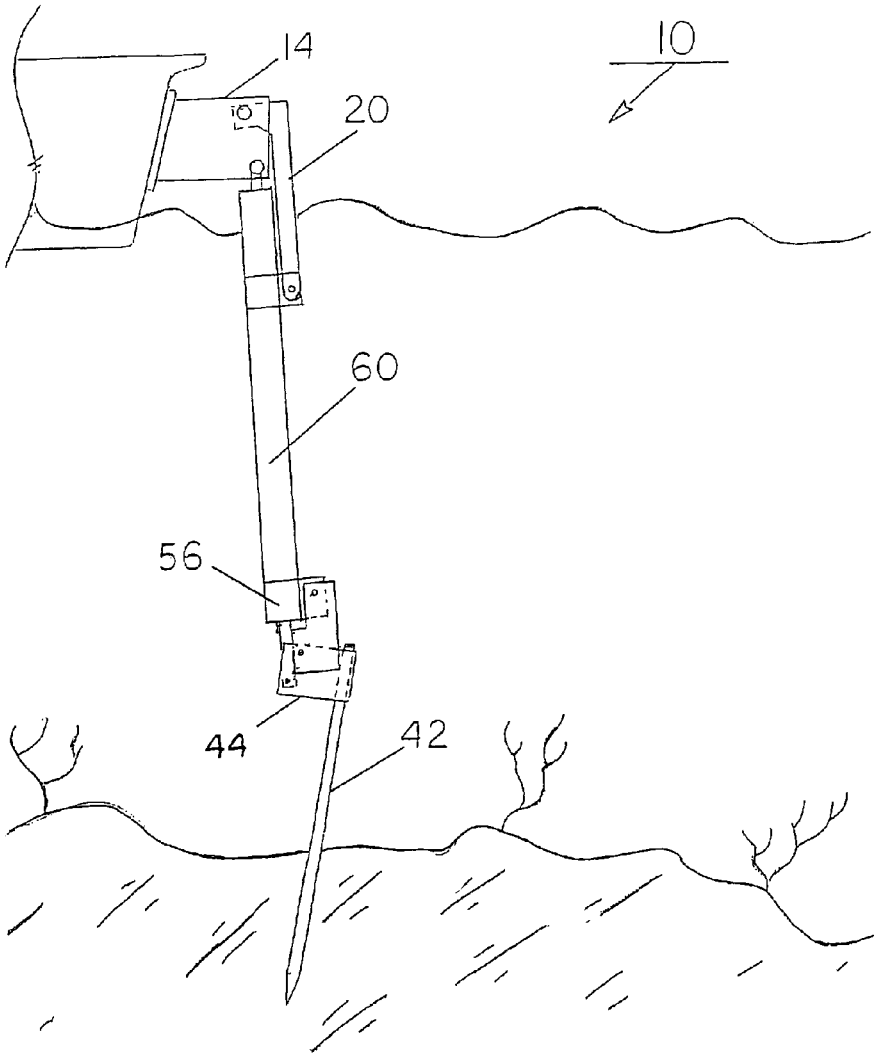
FIG. 1 is a side elevational view of a retractable anchoring pole system constructed in accordance with the principle of the present invention.
Figure 2:
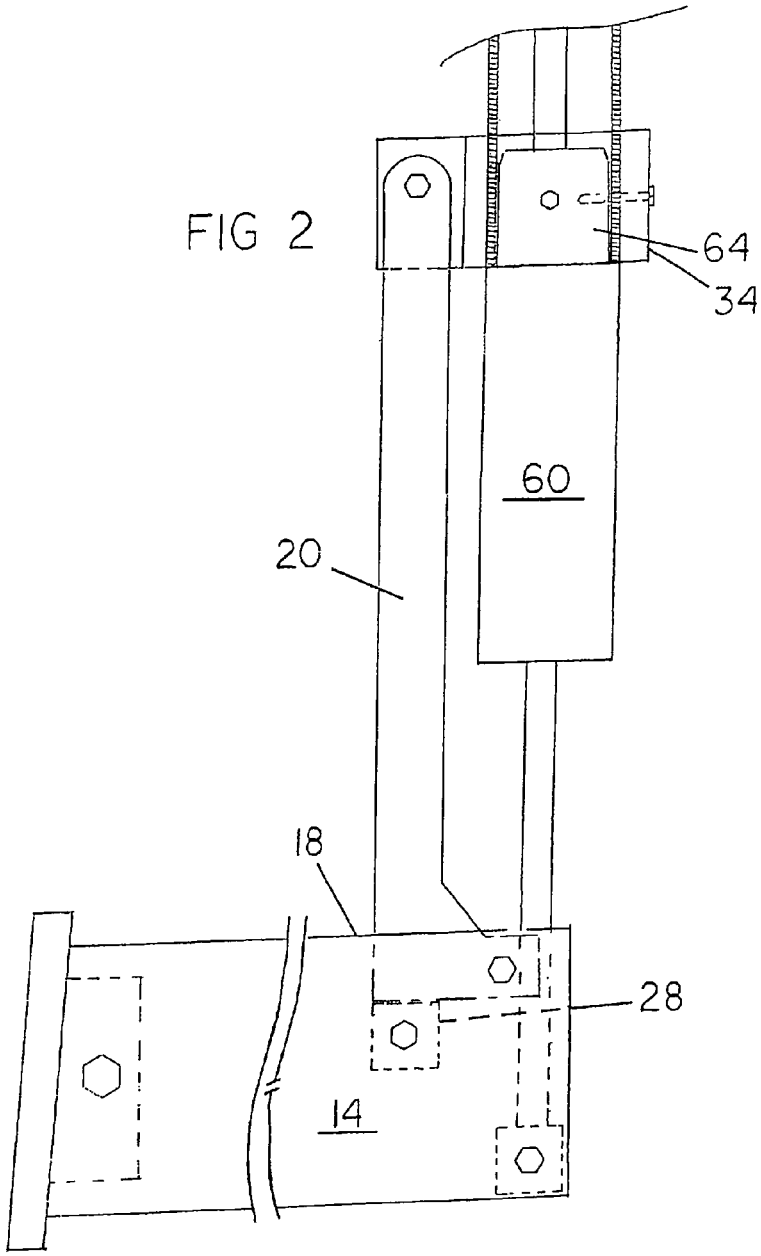
FIG. 2 is an enlarged side elevational view of the proximal assembly shown in FIG. 1 but in the raised orientation.
Figure 3:
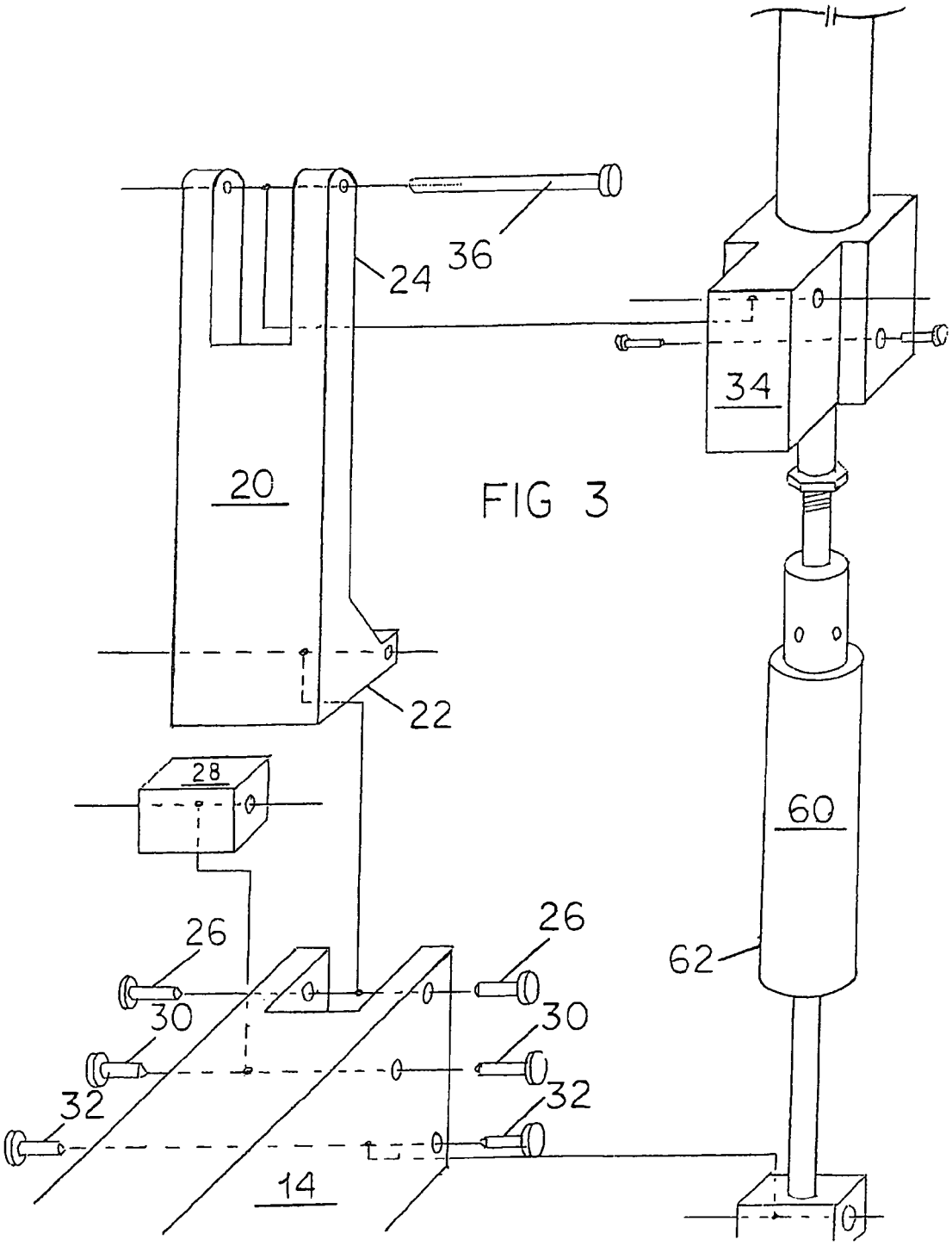
FIG. 3 is an exploded perspective view of the components shown in FIG. 2.
Figure 4:
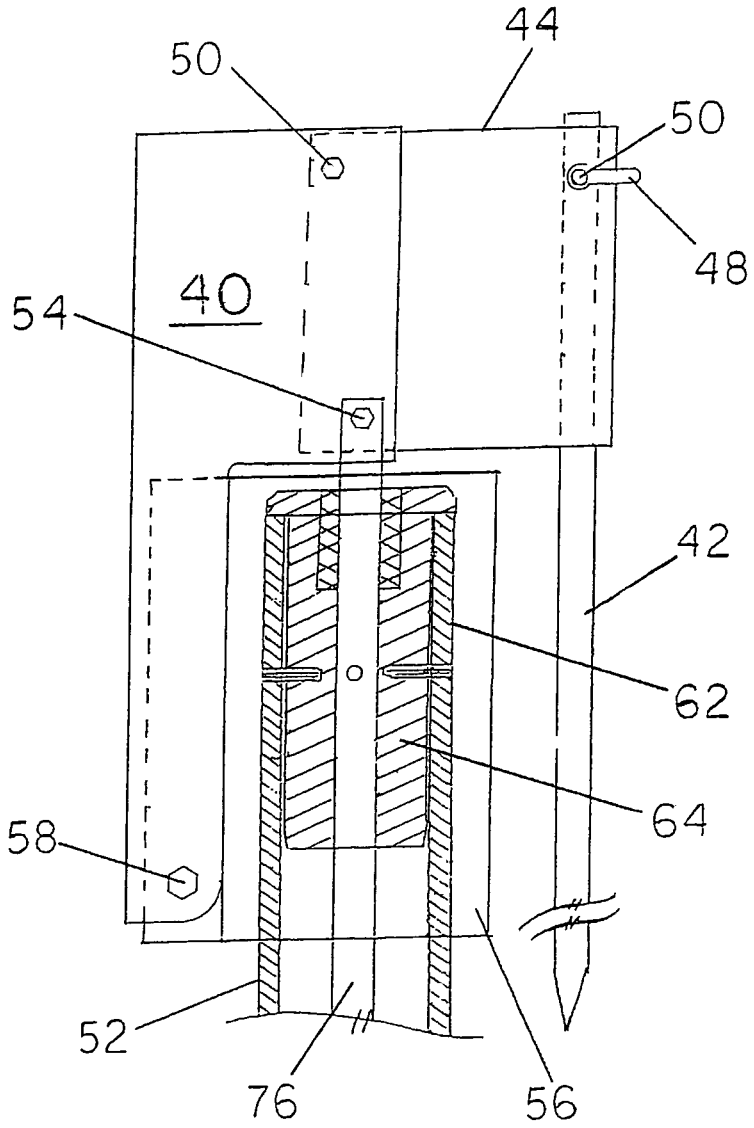
FIG. 4 is an enlarged side elevational view of the distal assembly of FIG. 1 but in the raised orientation.
Figure 5:
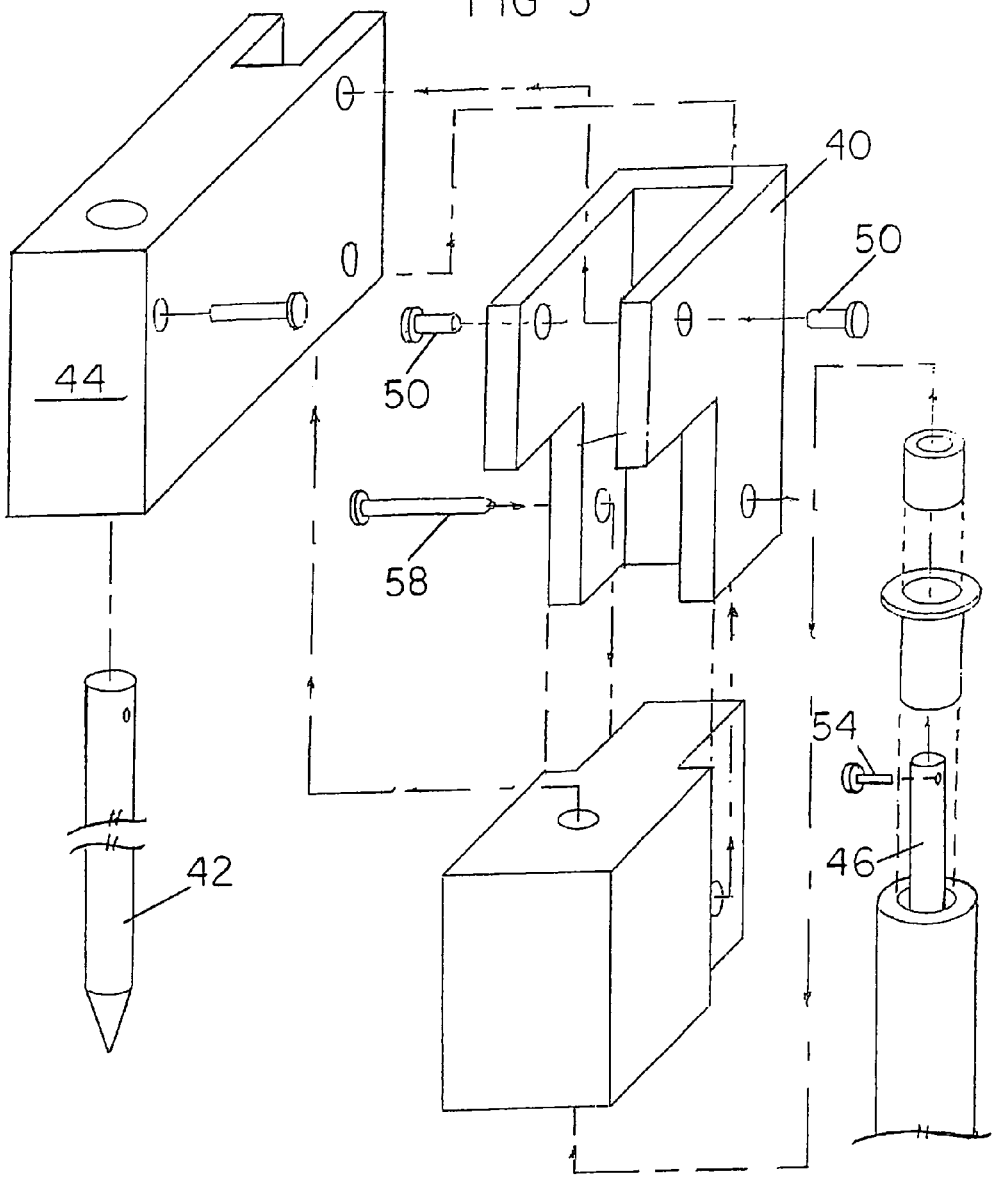
FIG. 5 is an exploded perspective view of the components shown in FIG. 4.
Figure 6:
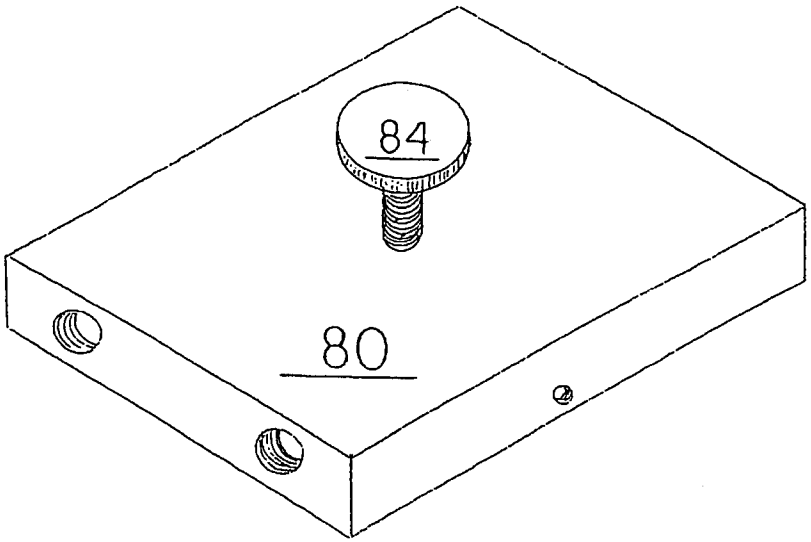
FIG. 6 is an enlarged perspective illustration of the fluid pathway assembly.
Figures 7, 8, 9:
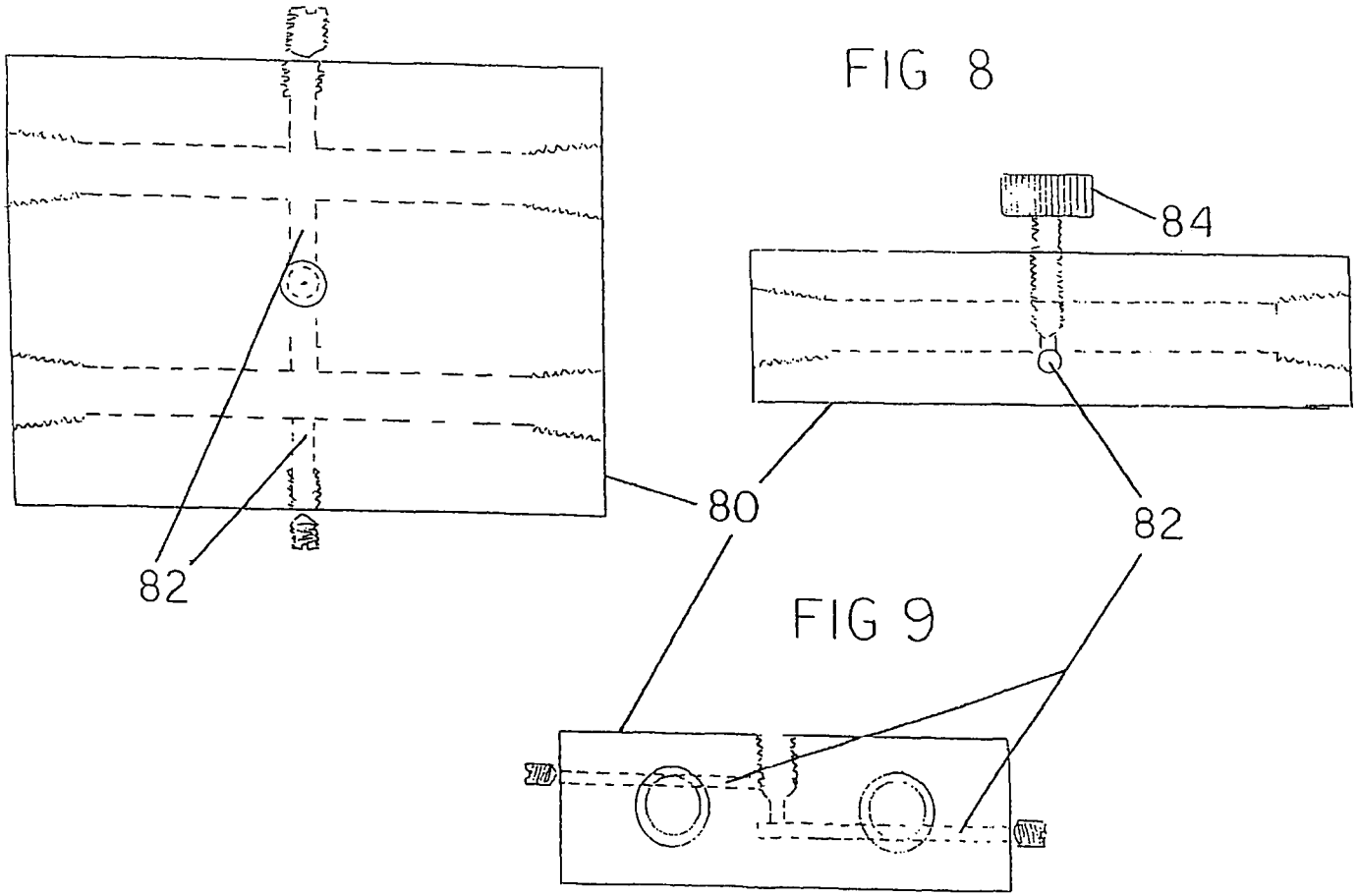
FIGS. 7, 8 and 9 are plan, end and side elevational views of the fluid pathway assembly shown in FIG. 6.

With reference now to the drawings, and in particular to FIG. 1 thereof, the preferred embodiment of the new and improved retractable anchoring pole system embodying the principles and concepts of the present invention and generally designated by the reference numeral 10 will be described.

The present invention, the retractable anchoring pole system 10 is comprised of a plurality of components. Such components in their broadest context include a proximal pivot assembly, a distal pivot assembly and an extension assembly. Such components are individually configured and correlated with respect to each other so as to attain the desired objective.

The retractable anchoring pole system 10 of the present invention is for raising and maintaining a boat anchoring pole in an inoperative raised orientation and for lowering and maintaining the anchoring pole in an operative lowered orientation and for raising and lowering the anchoring pole between the orientations. The raising and lowering and maintaining are done in a safe, convenient and economical manner.

First provided is a boat mount 14 having an inner edge coupled to the rear of a boat and a forked outer edge spaced rearwardly from the rear of the boat. The boat mount has an upper edge and a lower edge.

Next provided is a proximal pivot assembly 18. The proximal pivot assembly includes a proximal pivot arm 20 having a proximal end 22 and a forked distal end 24. A first pin 26 pivotally couples the proximal end of the proximal pivot arm to the boat mount adjacent to the outer and upper edges of the boat mount. An apertured stop block 28 is provided. A second pin 30 attaches the stop block to the boat mount between the first pin and the lower edge and between the first pin and the inner edge. The stop block is adapted to stop the rotational movement of the proximal pivot arm when moving to the raised orientation. A third pin 32 couples the boat mount adjacent to the outer and lower edges of the boat mount. A proximal collar 34 with a fourth pin 36 pivotally couples the proximal collar to the distal end of the proximal pivot arm. The proximal collar has a cylindrical proximal sleeve.

Next provided is a distal pivot assembly 40. The distal pivot assembly has an anchor pole 42 and an anchoring pole mounting plate 44. The mounting plate has an inner end and an outer end. A cylindrical support 46 at the outer end of the mounting plate removably receives the anchoring pole. A pivot lock 48 rotatable by a user secures and releases the anchoring pole within the cylindrical support. A fifth pin 50 extends through the mounting plate adjacent to the inner end of the mounting plate. A distal extension arm 52 has an interior end and an exterior end. A sixth pin 54 pivotally couples the exterior end of the extension arm to the mounting plate between the fifth pin and the anchoring pole. A distal collar 56 with a seventh pin 58 pivotally couples the distal collar to the proximal end of the distal extension arm. The distal collar has a cylindrical distal sleeve.

Next, an extension assembly 60 operatively couples the proximal and distal pivot assemblies. The extension assembly includes a cylinder 62 with a first end adjacent to the rearward extension and a second end adjacent to the anchor pole. A piston 64 is provided and is reciprocal within the cylinder. An upper line connector 66 is provided between the piston and the first end. A lower line connector 68 is provided between the piston and the second end. A hydraulic pump 70 with feed and return lines 72, 74 couples the pump to the line connectors to convey fluid to move the piston. A rod 76 is coupled to the piston. The rod has a first end coupled to the third pin for pivotal movement. The first end of the cylinder is secured within the proximal sleeve. The rod has a second end coupled to the fifth pin for pivotal movement. The second end of the cylinder is secured within the second sleeve.

Figure 10:
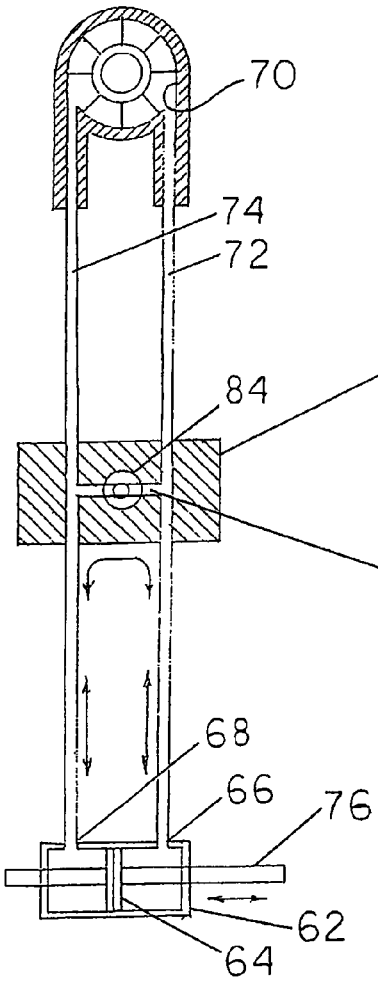
FIGS. 10 and 11 are schematic illustrations of the fluid flow path in the automatic and manual modes.
Figure 11:
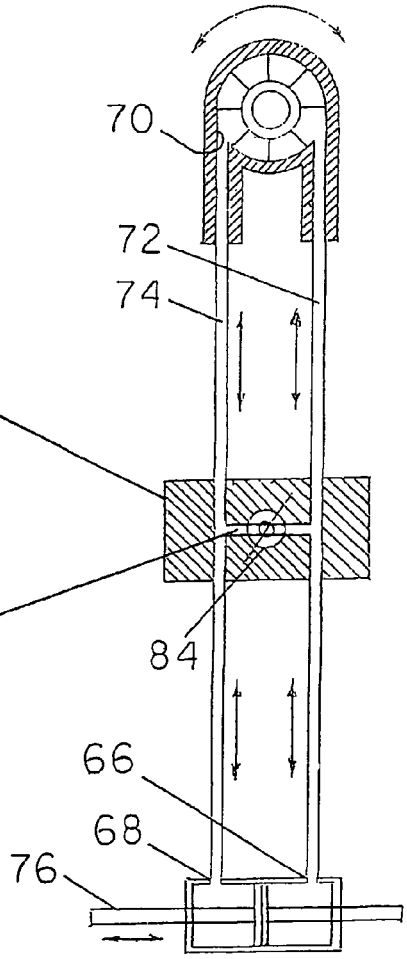
Figure 12:
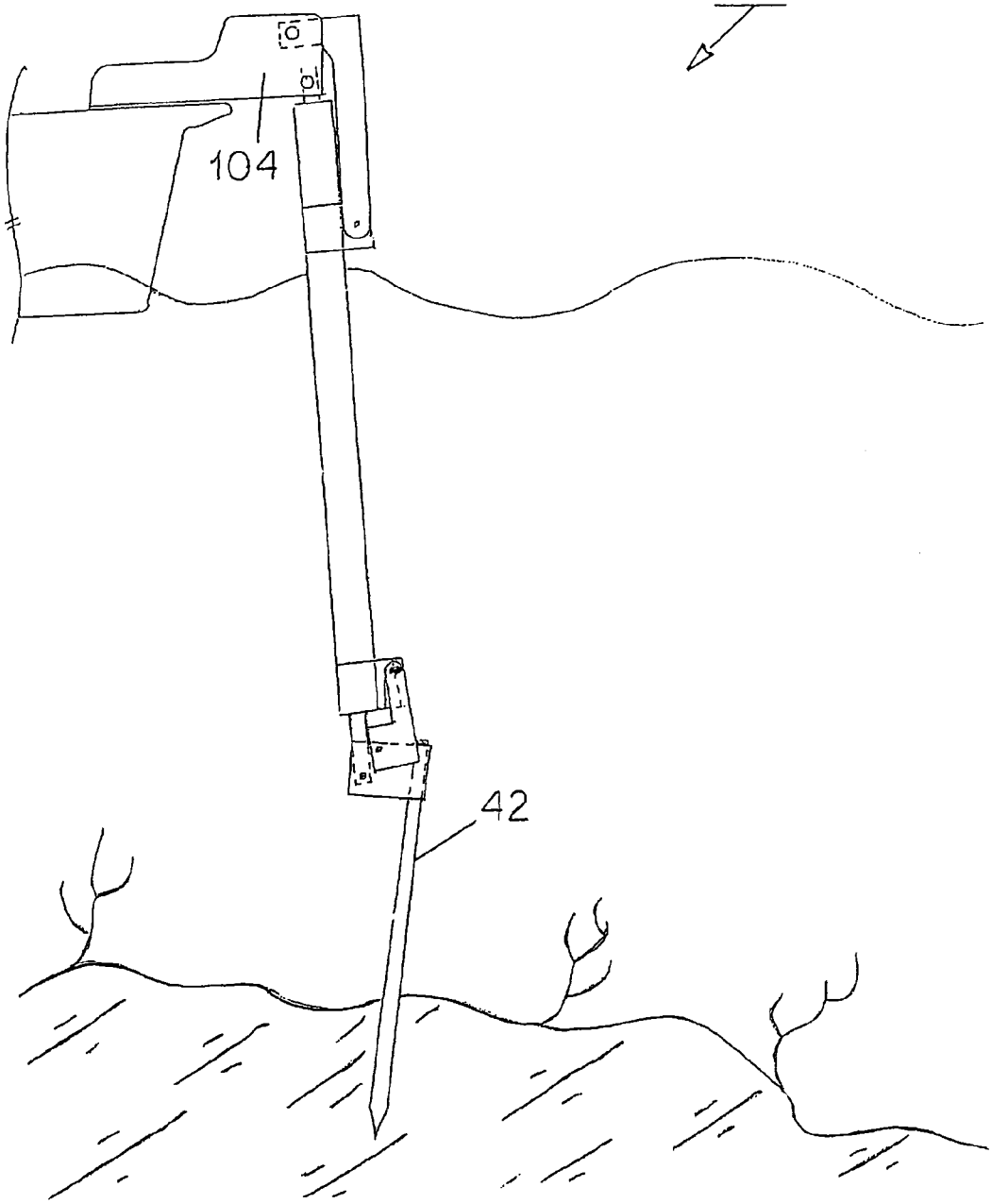
FIG. 12 is a side elevational view of a retractable anchoring pole system similar to FIG. 1 but illustrating an alternate embodiment of the invention.

Lastly, a bypass fluid pathway assembly 80 is provided. The bypass fluid pathway assembly is coupled to the feed line and return lines. A bypass line 82 connects the feed and return lines. The feed and return lines couple the cylinder and the hydraulic pump. A knurled bolt 84 is adapted to be screwed in a first direction to close the bypass line to allow the moving of the piston automatically by the pump. Note FIG. 10. The knurled bolt 84 is adapted to be screwed in a second direction to open the bypass line to allow the moving of the piston manually by hand. Note FIG. 11. The piston is adapted to be pivotally moved distally to move the anchoring pole to the lowered orientation. The piston is adapted to be pivotally moved proximally to move the anchoring pole to the raised orientation.

In an alternate embodiment of the invention, the boat mount 104 of the system 10 is secured to an upper surface or deck a boat.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A retractable anchoring pole system comprising:

a proximal pivot assembly having a proximal pivot arm with proximal and distal ends, a first pin pivotally coupling the proximal end of the proximal pivot arm to a boat mount, a second pin attaching a stop block to the boat mount, a third pin, a proximal collar with a fourth pin coupling the proximal collar to the distal end of the proximal pivot arm;

a distal pivot assembly having an anchor pole and an anchoring pole mounting plate receiving the anchoring pole, an interior end with a fifth pin, a distal extension arm having an exterior end, a sixth pin pivotally coupling the exterior end of the distal extension arm to the mounting plate, a distal collar with a seventh pin pivotally coupling the distal collar to the distal extension arm; and an extension assembly operatively coupling the proximal and distal pivot assemblies.

2. The system as set forth in claim 1 wherein the extension assembly includes a cylinder with a first end adjacent to the boat mount and a second end adjacent to the anchor pole, a piston reciprocal within the cylinder, an upper line connector between the piston and the first end, a lower line connector between the piston and the second end, a hydraulic pump with feed and return lines coupling the pump to line connectors to convey fluid to move the piston, a rod coupled to the piston, the rod having a first end coupled to the third pin for pivotal movement, the first end of the cylinder secured within the proximal sleeve, the rod having a second end coupled to the fifth pin for pivotal movement with the second end of the cylinder secured within the second sleeve.

3. The system as set forth in claim 2 and further including:

a bypass fluid pathway assembly coupled to the feed line and return lines, a bypass line connecting the feed and return lines, the feed and return lines coupling the cylinder and the hydraulic pump, a knurled bolt adapted to be screwed in a first direction to close the bypass line to allow the moving of the piston by the pump, the knurled bolt adapted to be screwed in a second direction to open the bypass line to allow the moving of the piston by hand, the piston adapted to be pivotally moved distally to move the anchoring pole to the lowered orientation, the piston adapted to be pivotally moved proximally to move the anchoring pole to the raised orientation.

4. The system as set forth in claim 1 wherein the boat mount is secured to the rear of a boat.

5. The system (10) as set forth in claim 1 wherein the boat mount (104) is secured to an upper surface or deck of a boat.

6. A retractable anchoring pole system (10) for raising and maintaining a boat anchoring pole in an inoperative raised orientation and for lowering and maintaining the anchoring pole in an operative lowered orientation and for raising and lowering the anchoring pole between the orientations, the raising and lowering and maintaining being done in a safe, convenient and economical manner, the system comprising, in combination:

a boat mount (14) having an inner edge coupled to the rear of a boat and a forked outer edge spaced rearwardly from the rear of the boat, the boat mount having an upper edge and a lower edge;

a proximal pivot assembly (18), the proximal pivot assembly including a proximal pivot arm (20) having a proximal end (22) and a forked distal end (24), a first pin (26) pivotally coupling the proximal end of the proximal pivot arm to the boat mount adjacent to the outer and upper edges of the boat mount, an apertured stop block (28), a second pin (30) attaching the stop block to the boat mount between the first pin and the lower edge and between the first pin and the inner edge, the stop block adapted to stop the rotational movement of the proximal pivot arm when moving to the raised orientation, a third pin (32) coupled to the boat mount adjacent to the outer and lower edges of the boat mount, a proximal collar (34) with a fourth pin (36) pivotally coupling the proximal collar to the distal end of the proximal pivot arm, the proximal collar having a cylindrical proximal sleeve;

a distal pivot assembly (40), the distal pivot assembly having an anchor pole (42) and an anchoring pole mounting plate (44), the mounting plate having an inner end and an outer end, a cylindrical support (46) at the outer end of the mounting plate removably receiving the anchoring pole, a pivot lock (48) rotatable by a user to secure and release the anchoring pole within the cylindrical support, a fifth pin (50) extending through the mounting plate adjacent to the inner end of the mounting plate, a distal extension arm (52) having an interior end and an exterior end, a sixth pin (54) pivotally coupling the exterior end of the extension arm to the mounting plate between the fifth pin and the anchoring pole, a distal collar (56) with a seventh pin (58) pivotally coupling the distal collar to the proximal end of the distal extension arm, the distal collar having a cylindrical distal sleeve; and an extension assembly (60) operatively coupling the proximal and distal pivot assemblies, the extension assembly including a cylinder (62) with a first end adjacent to the rearward extension and a second end adjacent to the anchor pole, a piston (64) reciprocal within the cylinder, an upper line connector (66) between the piston and the first end, a lower line connector (68) between the piston and the second end, a hydraulic pump (70) with feed and return lines (72)(74) coupling the pump to the line connectors to convey fluid to move the piston, a rod (76) coupled to the piston, the rod having a first end coupled to the third pin for pivotal movement, the first end of the cylinder secured within the proximal sleeve, the rod having a second end coupled to the fifth pin for pivotal movement with the second end of the cylinder secured within the second sleeve; and a bypass fluid pathway assembly (80) coupled to the feed line and return lines, a bypass line (82) connecting the feed and return lines, the feed and return lines coupling the cylinder and the hydraulic pump, a knurled bolt (84) adapted to be screwed in a first direction to close the bypass line to allow the moving of the piston by the pump, the knurled bolt adapted to be screwed in a second direction to open the bypass line to allow the moving of the piston by hand, the piston adapted to be pivotally moved distally to move the anchoring pole to the lowered orientation, the piston adapted to be pivotally moved proximally to move the anchoring pole to the raised orientation.

* * * * *